US009334462B2

(12) United States Patent
Bouffet et al.

(10) Patent No.: US 9,334,462 B2
(45) Date of Patent: May 10, 2016

(54) LUBRICANT COMPOSITIONS FOR TRANSMISSIONS

(71) Applicant: TOTAL MARKETING SERVICES, Puteaux (FR)

(72) Inventors: Alain Bouffet, Taluyers (FR); Alder Da Costa D'ambros, Lyons (FR); Richard Vernay, Saint Martin en Haut (FR); Gérard Thomesse, Vienne (FR)

(73) Assignee: TOTAL MARKETING SERVICES, Puteaux (FR)

( * ) Notice: Subject to any disclaimer, the term of this patent is extended or adjusted under 35 U.S.C. 154(b) by 37 days.

(21) Appl. No.: 14/364,988

(22) PCT Filed: Dec. 14, 2012

(86) PCT No.: PCT/EP2012/075645
§ 371 (c)(1),
(2) Date: Jun. 12, 2014

(87) PCT Pub. No.: WO2013/087889
PCT Pub. Date: Jun. 20, 2013

(65) Prior Publication Data

US 2015/0218481 A1 Aug. 6, 2015

(30) Foreign Application Priority Data

Dec. 16, 2011 (FR) ..... 11 61856

(51) Int. Cl.
*C10M 161/00* (2006.01)

(52) U.S. Cl.
CPC ..... *C10M 161/00* (2013.01); *C10M 2203/1006* (2013.01); *C10M 2203/1025* (2013.01); *C10M 2205/022* (2013.01); *C10M 2205/024* (2013.01); *C10M 2207/026* (2013.01); *C10M 2209/084* (2013.01); *C10M 2215/064* (2013.01); *C10M 2215/28* (2013.01); *C10M 2219/022* (2013.01); *C10M 2219/044* (2013.01); *C10M 2219/046* (2013.01); *C10M 2219/106* (2013.01); *C10M 2223/045* (2013.01); *C10M 2223/047* (2013.01); *C10M 2223/049* (2013.01); *C10N 2230/06* (2013.01); *C10N 2230/54* (2013.01); *C10N 2240/04* (2013.01); *C10N 2240/044* (2013.01); *C10N 2240/10* (2013.01)

(58) Field of Classification Search
CPC ..... C10M 161/00; C10M 2203/1006; C10M 2203/1025; C10M 2205/022; C10M 2205/024; C10M 2207/026; C10M 2215/064; C10M 2215/2215; C10M 2215/28; C10M 2219/022; C10M 2219/044; C10M 2219/046; C10M 2219/106; C10M 2223/045; C10M 2223/047; C10M 2223/049; C10M 2230/06; C10M 2230/54; C10M 2240/04; C10M 2240/044; C10M 2240/10
See application file for complete search history.

(56) References Cited

U.S. PATENT DOCUMENTS

| | | | | |
|---|---|---|---|---|
| 4,344,854 | A | 8/1982 | Davis et al. | |
| 4,707,301 | A | 11/1987 | Lange | |
| 5,135,670 | A | 8/1992 | Johnson et al. | |
| 5,439,605 | A | 8/1995 | Khorramian | |
| 6,268,316 | B1 * | 7/2001 | Tanaka | C10M 141/08 508/291 |
| 8,664,169 | B2 * | 3/2014 | Bouffet | C10M 169/041 508/110 |
| 2005/0119134 | A1 | 6/2005 | Tequi et al. | |
| 2008/0280793 | A1 | 11/2008 | Tequi et al. | |
| 2009/0270294 | A1 | 10/2009 | Souchez et al. | |
| 2011/0003724 | A1 | 1/2011 | Bouffet | |
| 2011/0177989 | A1 | 7/2011 | Bouffet | |
| 2012/0053095 | A1 | 3/2012 | Tequi et al. | |
| 2012/0129742 | A1 | 5/2012 | Matray et al. | |
| 2012/0172264 | A1 | 7/2012 | Tequi et al. | |
| 2013/0096041 | A1 | 4/2013 | Matray et al. | |
| 2013/0281331 | A1 | 10/2013 | Bardin | |

FOREIGN PATENT DOCUMENTS

WO WO2010038147 * 4/2010

OTHER PUBLICATIONS

English Translation of the International Preliminary Report on Patentability, IB, Geneva, established Jun. 17, 2014, incorporating the English Translation of the Written Opinion of the ISA, mailed Feb. 14, 2013.

* cited by examiner

*Primary Examiner* — Cephia D Toomer
(74) *Attorney, Agent, or Firm* — Harness, Dickey & Pierce, P.L.C.

(57) ABSTRACT

A lubricating composition includes one or more base oils, at least one dimercaptothiadiazole derivative, at least one ethylene and alpha-olefin copolymer and at least one amine thiophosphate. The composition can be used for lubricating transmissions such as gearboxes and axles, preferably the manual gearboxes of motor vehicles and enable a reduction in the fuel consumption of vehicles, in particular of motor vehicles, due to the combination of the ethylene and alpha-olefin copolymer, dimercaptothiadiazole derivative and amine thiophosphate which decreases the coefficient of friction of the lubricating composition.

15 Claims, No Drawings

LUBRICANT COMPOSITIONS FOR TRANSMISSIONS

CROSS-REFERENCE TO RELATED APPLICATIONS

This application is a National Phase Entry of International Application No. PCT/EP2012/075645, filed on Dec. 14, 2012, which claims priority to French Patent Application Serial No. 1161856, filed on Dec. 16, 2011, both of which are incorporated by reference herein.

TECHNICAL FIELD

The present invention relates to lubricant compositions for transmissions, in particular for gearboxes, comprising a specific combination of additives allowing a reduction in the coefficient of friction of said lubricant compositions, thus making it possible to limit the fuel consumption of motor vehicles. The compositions according to the invention are suitable for all types of vehicles, in particular light vehicles, and are particularly suitable for manual gearboxes, axles or dual clutch gearboxes.

BACKGROUND

Current environmental concerns, in particular with a view to reducing $CO_2$ emissions, lead to a reduction in the fuel consumption of light vehicles. This reduction in energy consumption can be carried out via elements such as the engine and/or the transmissions, such as the axles or the dual clutch gearboxes and in particular manual gearboxes. In order to reduce fuel consumption, it is possible to use polymers which improve the viscosity index (VI) in order to act on the viscosity of the lubricant or to use friction modifiers in order to act on the coefficient of friction of the lubricant. U.S. Pat. Nos. 6,268,316, 4,707,301 and 5,439,605 describe a lubricant composition comprising an ethylene/propylene copolymer and a dimercaptothiadiazole derivative.

SUMMARY

The applicant has now noted that the use of an ethylene/alpha-olefin copolymer, which is known as a polymeric viscosity index improver and not as a friction modifier, makes it possible to reduce the coefficient of friction of lubricant compositions when combined with a dimercaptothiadiazole derivative and an amine thiophosphate. The dimercaptothiadiazole derivatives are known as corrosion inhibitors and extreme-pressure additives and not as friction modifiers. Surprisingly, the applicant has noticed that it is possible to formulate transmission oils with very low coefficients of friction from a composition containing a compound chosen from the dimercaptothiadiazoles, a compound chosen from the group of the ethylene/alpha-olefin copolymers and an amine thiophosphate. The lubricant compositions according to the invention have low coefficients of friction without the addition of friction modifiers.

Without wishing to be bound by any theory, the mixture, containing at least one dimercaptothiadiazole, at least one ethylene/alpha-olefin copolymer and at least one amine thiophosphate, has a synergistic effect on lowering the coefficient of friction.

Moreover, the lubricant composition comprising a mixture of dimercaptothiadiazole, ethylene/alpha-olefin copolymer and amine thiophosphate also has the following advantages:

- Low coefficients of friction without a supply of friction modifiers,
- Formulation improving the efficiency of the transmissions,
- Lower use of polymer in the oil,
- Formulae with high heat stability.

A subject of the present invention is a lubricant composition comprising one or more base oils, at least one dimercaptothiadiazole derivative, at least one ethylene and alpha-olefin copolymer and at least one amine thiophosphate. Preferentially, the lubricant composition according to the invention comprises at least one ethylene and alpha-olefin copolymer comprising from 3 to 30 carbon atoms, preferably from 3 to 24, more preferentially from 3 to 20, even more preferentially from 3 to 10, even more preferentially from 3 to 6.

Preferentially, the ethylene and alpha-olefin copolymer according to the invention has the general formula (I):

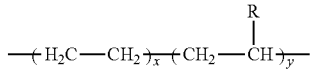

(I)

in which R is an alkyl group having from 1 to 8 carbon atoms, preferably 1 to 3 carbon atoms, x and y are such that the ratio x/y is comprised between 0.5 and 2 and the sum x+y is comprised between 50 to 150.

Preferentially, the lubricant composition according to the invention comprises a quantity of ethylene and alpha-olefin copolymer comprised between 1 to 20% by mass, with respect to the total mass of lubricant composition, preferably from 2 to 15%, more preferentially from 4 to 10%, even more preferentially from 5 to 9%. Preferentially, the dimercaptothiadiazole derivative contained in the lubricant composition according to the invention is chosen from 4,5-dimercapto-1,2,3-thiadiazole, 3,5-dimercapto-1,2,4-thiadiazole, 3,4-dimercapto-1,2,5-thiadiazole, and 2,5-dimercapto-1,3,4-thiadiazole derivatives, used alone or in a mixture.

Preferentially, the dimercaptothiadiazole derivative according to the invention has formula (II) or (III) as general formula, used alone or in a mixture:

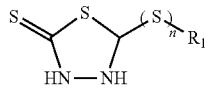

(II)

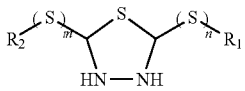

(III)

in which, $R_1$ and $R_2$ are, independently of each other, hydrogen atoms, linear and/or branched alkyl groups comprising from 1 to 24 carbon atoms, preferably from 2 to 18, more preferentially from 4 to 16, even more preferentially from 8 to 12, or aromatic substituents, n and m being, independently of each other, integers chosen from the group formed by the integers 1, 2, 3, and 4.

Preferentially, the lubricant composition according to the invention comprises from 0.1 to 10% by mass of dimercaptothiadiazole derivative, with respect to the total mass of the lubricant composition, preferably 0.2 to 5%, more preferentially from 0.3 to 2%, even more preferentially from 0.5 to 1%.

The lubricant composition according to the invention comprises an amine thiophosphate of general formula (IVa):

(IV a)

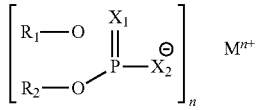

in which $X_1$ and $X_2$ are independently of each other a sulphur atom or an oxygen atom, at least one of them being a sulphur atom, $R_1$ and $R_2$ are either a hydrogen atom or alkyl groups having between 1 to 22 carbon atoms, preferably between 6 to 18, M is an ammonium formed from a primary, secondary or tertiary amine, of formula $R_3R_4R_5R_6N$, where $R_3$, $R_4$, $R_5$, $R_6$ are either a hydrogen atom or an alkyl group comprising from 1 to 18 carbon atoms, and then n=1.

Particularly preferred compounds are the dithiophosphates ($X_1$ and $X_2$ are sulphur atoms). Preferentially, the lubricant composition according to the invention has a quantity of amine thiophosphate of formula (IVa) comprised between 0.2 to 10% by mass, with respect to the total mass of lubricant composition, preferably from 0.5 to 8%, more preferentially of 1 to 5%, even more preferentially from 2 to 4%. Preferentially, the lubricant composition according to the invention moreover comprises a polymethacrylate.

Preferentially, the lubricant composition according to the invention moreover comprises a dispersant derived from polyisobutene. Preferentially, the lubricant composition according to the invention moreover comprises an amine-type antioxidant additive. Preferentially, the lubricant composition according to the invention moreover comprises a phenol-type anti-corrosion additive. Preferentially, the lubricant composition according to the invention has a kinematic viscosity at 100° C. according to the standard ASTM D445 comprised between 4 and 40 cSt, between 4.1 and 32.5 cSt and preferably between 6 and 18.5 cSt.

The present invention relates to the use of a lubricant composition for lubricating transmissions such as the gearboxes, the axles, preferably the manual gearboxes of motor vehicles. Preferentially the invention relates to the use of a lubricant composition for the lubrication of transmissions in order to reduce the fuel consumption of vehicles, in particular of motor vehicles. The present invention relates to the use of at least one ethylene and alpha-olefin copolymer and at least one dimercaptothiadiazole derivative in order to reduce the coefficient of friction of a lubricant composition.

In an embodiment, the invention relates to the use of at least one ethylene and alpha-olefin copolymer, at least one dimercaptothiadiazole derivative and at least one amine thiophosphate in order to reduce the coefficient of friction of a lubricant composition. A subject of the invention is also a process for reducing the coefficient of friction of a lubricant composition wherein at least one ethylene and alpha-olefin copolymer and at least one dimercaptothiadiazole derivative have been added into at least one base oil. In an embodiment, the invention relates to a process for reducing the coefficient of friction of a lubricant composition wherein at least one ethylene and alpha-olefin copolymer, at least one dimercaptothiadiazole derivative and at least one amine thiophosphate have been are added into at least one base oil.

DETAILED DESCRIPTION

One of the essential components of the lubricant compositions according to the invention is an ethylene and alpha-olefin copolymer. The ethylene and alpha-olefin copolymer, while being a viscosity index improver like the polymethacrylates that it can replace, provides the additional advantage that it can reduce the coefficient of friction of said lubricant compositions.

The copolymer used in the present invention is an ethylene and alpha-olefin copolymer. The alpha-olefin is an alpha-olefin comprising from 3 to 30 carbon atoms, preferably from 3 to 24, more preferentially from 3 to 20, even more preferentially from 3 to 10, even more preferentially from 3 to 6. Examples of alpha-olefins that can be used are propylene, butene, pentene, hexene, heptene, octene, nonene, decene, in particular 1-butene, 1-pentene, 1-hexene, 1-octene.

Preferably, the ethylene and alpha-olefin copolymer has the general formula (I):

(I)

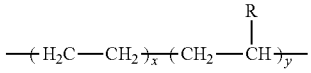

where is R is an alkyl group having from 1 to 8 carbon atoms, preferably 1 to 3 carbon atoms, x and y are such that the ratio x/y is comprised between 0.5 and 2 and the sum x+y is comprised between 50 to 150.

Preferentially, R represents a methyl group, and x and y are such that the ratio x/y is comprised between 0.5 to 1.5 and the sum x+y is comprised between 70 and 130. Preferentially, R is a methyl group, x is equal to 40 and y is equal to 40. Preferentially, the ethylene and alpha-olefin copolymer according to the invention is chosen from the alpha-olefin copolymers making it possible to limit the loss of viscosity of the lubricant composition measured at 100° C. according to the standardized test KRL-45-99 at a value less than or equal to 5%.

The lubricant compositions according to the invention comprise from 1 to 20% by mass of ethylene/alpha-olefin copolymer, with respect to the total mass of lubricant composition, preferably from 2 to 15%, more preferentially from 4 to 10%, even more preferentially from 5 to 9%. Lucant HC600 marketed by the company MITSUI may be mentioned as an example of an ethylene/alpha-olefin copolymer according to the invention.

Surprisingly, the effect of the ethylene/alpha-olefin copolymer on lowering the coefficient of friction of the lubricant compositions according to the invention, was observed in the presence of a dimercaptothiadiazole derivative. On the other hand, this effect was not observed with the use of other additives.

The lubricant compositions according to the invention therefore comprise at least one dimercaptothiadiazole derivative. The thiadiazoles are heterocyclic compounds comprising two nitrogen atoms, a sulphur atom, two carbon atoms and two double bonds, of general formula $C_2N_2SH_2$, which can exist in the following forms, 1,2,3-thiadiazole, 1,2,4-thiadiazole, 1,2,5-thiadiazole, 1,3,4-thiadiazole respectively:

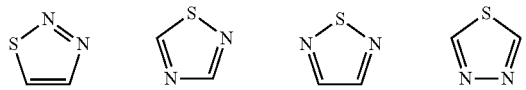

1,2,3-thiadiazole 1,2,4-thiadiazole 1,2,5-thiadiazole 1,3,4-thiadiazole

By dimercaptothiadiazole derivative according to the invention, is meant chemical compounds which are derivatives of the four dimercaptothiadiazole molecules below, 4,5-dimercapto-1,2,3-thiadiazole, 3,5-dimercapto-1,2,4-thiadiazole, 3,4-dimercapto-1,2,5-thiadiazole and 2,5-dimercapto-1,3,4-thiadiazole used alone or in a mixture:

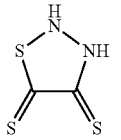

4,5-dimercapto-1,2,3-thiadiazole

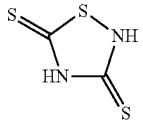

3,5-dimercapto-1,2,4-thiadiazole

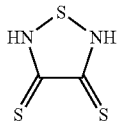

3,4-dimercapto-1,2,5-thiadiazole

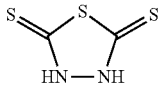

2,5-dimercapto-1,3,4-thiadiazole

In particular, taking 2,5-dimercapto-1,3,4-thiadiazole as an example, the 2,5-dimercapto-1,3,4-thiadiazole derivatives are molecules of general formula (II) or (III):

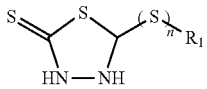

(II)

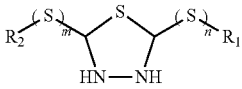

(III)

in which, $R_1$ and $R_2$ are, independently of each other, hydrogen atoms, linear and/or branched alkyl groups comprising from 1 to 24 carbon atoms, preferably from 2 to 18, more preferentially from 4 to 16, even more preferentially from 8 to 12, or aromatic substituents, n and m being independently of each other integers chosen from the group formed by the integers 1, 2, 3 or 4.

The lubricant compositions according to the invention comprise from 0.1 to 10% by mass, with respect to the total mass of the lubricant composition, of dimercaptothiadiazole derivative, preferably from 0.2 to 5%, more preferentially from 0.3 to 2%, even more preferentially from 0.5 to 1%. Anglamol 2198 marketed by the company LUBRIZOL can be mentioned as an example of a dimercaptothiadiazole derivative according to the invention.

The compositions according to the invention comprise at least one amine thiophosphate of formula (IVa):

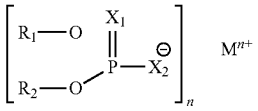

(IVa)

where $X_1$ and $X_2$ are, independently of each other, a sulphur atom or an oxygen atom, at least one of them being a sulphur atom, $R_1$ and $R_2$ are either a hydrogen atom or alkyl groups having between 1 and 22 carbon atoms, preferably between 6 and 18, M is an ammonium formed from a primary, secondary or tertiary amine, of formula $R_3R_4R_5R_6N$, where $R_3$, $R_4$, $R_5$, $R_6$ are either a hydrogen atom or an alkyl group comprising from 1 to 18 carbon atoms, and then n=1. Particularly preferred compounds of formula (IVa) are the amine dithiophosphates in which $X_1$ and $X_2$ are sulphur atoms and M, $R_3$, $R_4$, $R_5$, $R_6$ are as defined above.

The lubricant compositions according to the invention can contain any type of lubricating base, mineral, synthetic or natural, animal or vegetable, suited to their use. The base oil(s) used in the lubricant compositions according to the present invention can be oils of mineral or synthetic origin of Groups I to V according to the classes defined in the API classification (or their equivalents according to the ATIEL classification) as summarized below, alone or in a mixture.

| | Saturates content | Sulphur content | Viscosity index (VI) |
|---|---|---|---|
| Group I Mineral oils | <90% | >0.03% | 80 ≤ VI < 120 |
| Group II Hydrocracked oils | ≥90% | ≤0.03% | 80 ≤ VI < 120 |
| Group III Hydrocracked or hydro-isomerized oils | ≥90% | ≤0.03% | ≥120 |
| Group IV | Polyalpha-olefins (PAOs) | | |
| Group V | Esters and other bases not included in bases of Groups I to IV | | |

The mineral base oils according to the invention include all types of bases obtained by atmospheric and vacuum distillation of crude oil, followed by refining operations such as solvent extraction, deasphalting, solvent dewaxing, hydrotreatment, hydrocracking and hydroisomerization, and hydrofinishing.

The base oils of the compositions according to the present invention can also be synthetic oils, such as certain esters of carboxylic acids and of alcohols, or polyalphaolefins. The polyalphaolephins used as base oils are for example obtained from monomers having from 4 to 32 carbon atoms (for example octene, decene), and a viscosity at 100° C. comprised between 1.5 and 15 cSt according to the standard ASTM D 445. Their weight-average molecular mass is typically comprised between 250 and 3000 measured according to the standard ASTM D5296. Mixtures of synthetic and mineral oils can also be used.

There is no limitation as regards the use of a particular lubricating base for producing the lubricant compositions according to the invention, except that they must have properties, in particular in terms of viscosity, viscosity index, sulphur content, oxidation resistance, suitable for use in a gearbox, in particular in a motor vehicle gearbox, in particular in a manual gearbox.

Preferentially, the lubricating bases represent at least 50% by mass, with respect to the total mass of the lubricant composition, preferentially at least 60%, or also at least 70%. Typically, they represent between 75 and 90% by mass, with respect to the total mass of the lubricant compositions according to the invention. Preferentially, the lubricant compositions according to the invention comprise mineral bases of Group I and/or Ill, or synthetic bases of Group IV according to the API classification.

Preferentially, the lubricant compositions according to the invention have a kinematic viscosity at 100° C. measured according to the standard ASTM D445 comprised between 4 and 41 cSt, according to the SAE J 30 classification, preferably between 4.1 and 32.5 cSt. The preferred grades are all the grades comprised between grades 75W and 140, in particular grades 75W, 75W80 and 75W90. Preferentially, the lubricant compositions according to the invention have a viscosity index (VI) greater than 120 (standard ASTM 2270).

The lubricant compositions according to the invention can also contain other additives such as anti-wear and/or extreme-pressure additives. Anti-wear and/or extreme pressure additives of the phosphorus- and sulphur-containing, phosphorus-containing or sulphur-containing type are used, alone or in a mixture. The anti-wear and/or extreme-pressure phosphorus- and sulphur-containing additives are for example and non-limitatively thiophosphoric acid, thiophosphorous acid, the esters of these acids, salts thereof, and the dithiophosphates, mono- or di-thiophosphates other than the amine thiophosphates according to the invention, particularly the zinc dithiophosphates.

By way of examples of phosphorus- and sulphur-containing anti-wear and extreme-pressure additives, those which comprise from 1 to 3 sulphur atoms may be mentioned, such as monobutylthiophosphate, monooctylthiophosphate, monolaurylthiophosphate, dibutylthiophosphate, dilaurylthiophosphate, tributylthiophosphate, trioctylthiophosphate, triphenylthiophosphate, trilaurylthiophosphate, monobutylthiophosphate, monoctylthiophosphite, monolaurylthiophosphite, dibutylthiophosphite, dilaurylthiophosphite, tributylthiophosphite, trioctylthiophosphite, triphenylthiophosphite, trilaurylthiophosphite and salts thereof. Examples of salts of the thiophosphoric acid and thiphosphorous acid esters are those obtained by reaction with a nitrogen-containing compound such as ammonia or an amine or zinc oxide or zinc chloride.

According to a preferred embodiment, the phosphorus- and sulphur-containing anti-wear and extreme-pressure additives of the compositions according to the invention are thiophosphates, corresponding to formula (IVb):

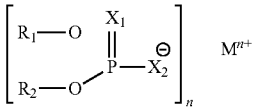

(IVb)

where $X_1$ and $X_2$ are independently of each other a sulphur atom or an oxygen atom, at least one of them being a sulphur atom, $R_1$ and $R_2$ are either a hydrogen atom or alkyl groups having between 1 and 22 carbon atoms, preferably between 6 and 18, M is a metal chosen from the group formed by the Groups IIA, III, VA, VIA, IB, VIB and VIII of the periodic table, n+ being the valency of said metal. Particularly preferred compounds of formula (IVb) are dithiophosphates ($X_1$ and $X_2$ are sulphur atoms), preferentially zinc dithiophosphates.

The lubricant compositions can also contain phosphorus-containing anti-wear and extreme-pressure additives, such as for example the alkyl phosphates or alkyl phosphonates, phosphoric acid, phosphorous acid, the mono-, di- and tri-esters of phosphorous acid and of phosphoric acid, and salts thereof. The lubricant compositions can also contain sulphur-containing anti-wear and extreme-pressure additives. Dithiocarbamates, thiadiazoles and benzothiazoles, and sulphur-containing olefins may be mentioned as examples of sulphur-containing anti-wear and extreme-pressure additives.

The most common sulphur-containing olefins are called SIBs, for "Sulphurized IsoButylenes". These sulphur-containing olefins are generally obtained by a reaction of sulphurization of olefins with sulphur, hydrogen sulphide or hydrated alkali metal sulphides, for example sodium sulphide. An example of processes for the preparation of such sulphur-containing olefins is for example described in the U.S. Pat. Nos. 4,344,854 and 5,135,670. A very wide range of olefins can thus be sulphurized. Preferentially, sulphur-containing olefins are manufactured from isobutylene, diisobutylene, triisobutylene, tripropylene or tetrapropylene. The SIBs thus produced are mixtures of compounds with a poorly-defined structure comprising, among other things, trithione, dithiolethione and halogen impurities, and a high level of active sulphur.

The lubricant compositions according to the invention comprise from 0.2 to 10% by mass of anti-wear and/or extreme pressure agents, with respect to the mass of lubricant composition, preferably from 0.5 to 8%, from 1 to 5%, preferentially from 2 to 4%. The compositions according to the invention can also comprise, in addition to the ethylene and alpha-olefin copolymer, other viscosity index (VI) improving polymers such as the polymethacrylates, polyacrylates, olefin copolymers, Ethylene Propylene Diene Monomers (EPDM), polybutenes, styrene and olefin copolymers, hydrogenated or not. The preferred polymers are the polymethacrylates (PMA).

The polymethacrylates are for example linear, non-dispersed polymethacrylates, of low mass or of average mass. By low mass, is meant PMAs with a weight-average molecular mass Mw less than 20,000 (standard ASTM D5296). By average mass, is meant PMAs with a weight-average molecular mass Mw comprised between 30,000 and 90,000, (preferentially about 50,000 (ASTM D5296). By high mass, is meant PMAs with a weight-average molecular mass Mw greater than 100,000 (ASTM D5296).

The lubricant compositions according to the invention can also contain all types of additives suitable for use in the formulations of oils for transmissions, for example one or more additives chosen from the antioxidant, corrosion-inhibiting and dispersant additives, present in the levels usually required for the application. The preferred dispersants are the polyisobutylenes (PIB), succinic anhydride polyisobutylene, and amine derivatives of succinic anhydride polyisobutylene (PIB succinimides). The preferred antioxidants are for example aminated antioxidants, preferably diphenylamines such as the octadiphenylamines, phenyl-alpha-naphthyl amines, or phenolic antioxidants (dibutylhydroxytoluene BHT and derivatives) or sulphur-containing antioxidants (sulphurized phenates). The preferred anti-corrosion additives are phenolic derivatives, in particular ethoxylated phenolic derivatives, substituted by alkyl groups in the ortho position.

The invention also relates to a process for lubricating transmissions such as the gearboxes, the axles, preferably the manual gearboxes of motor vehicles, said process utilizing a lubricant composition as defined above. Preferably, this process makes it possible to reduce the fuel consumption of vehicles, in particular of motor vehicles. The invention also relates to a process for lubricating transmissions, such as the gearboxes, the axles, preferably the manual gearboxes of motor vehicles, said process utilizing at least one ethylene and alpha-olefin copolymer and at least one dimercaptothiadiazole derivative.

In an embodiment, the invention relates to a process for lubricating at least one transmission member, the process comprising a step of bringing into contact a lubricant composition comprising at least one ethylene and alpha-olefin copolymer and at least one dimercaptothiadiazole derivative. In another embodiment, the invention relates to a process for lubricating at least one transmission member, the process comprising a step of bringing into contact a lubricant composition comprising at least one ethylene and alpha-olefin copolymer, at least one dimercaptothiadiazole derivative and at least one amine thiophosphate. By transmission member is meant within the meaning of the present invention, for example an axle or a gearbox, in particular a motor vehicle gearbox. Preferably, this process makes it possible to reduce the coefficient of friction of a lubricant composition.

EXAMPLES

Lubricant compositions according to the invention and control lubricant compositions are prepared from:

- base oil of Group III with a viscosity at 100° C. of 3 cSt according to the standard ASTDM D445 and a viscosity index of 125, according to the standard ASTM 2270,
- ethylene and alpha-olefin copolymer of general formula (I) where R is a methyl group, x is equal to approximately 40 and y is equal to approximately 40 and with a weight-average molecular mass Mw equal to approximately 8880, according to the standard ASTM D5296,
- dimercaptothiadiazole derivative which is a mixture of products of general formula (II) and/or (III) with $R_1$ and $R_2$ being saturated linear alkyl groups comprising an average number of carbon atoms of 12, n being equal to 1,
- amine thiophosphate which has the general formula (IVa) where $X_1$ and $X_2$ are sulphur atoms, $R_1$ and $R_2$ are alkyl groups having 6 carbon atoms, M is an ammonium formed from a primary amine of formula $R_3R_4R_5N$, where $R_3$, $R_4$, $R_5$ are hydrogen atoms and an alkyl group of 11 carbon atoms respectively, and n=1,
- a polymethacrylate which is a non-dispersed linear compound, with a weight-average molecular mass Mw equal to 16190 (ASTM D5296), with a number-average molecular mass Mn equal to 9990 (ASTM D5296), with a polydispersity index PI (PI=Mw/Mn) equal to 1.6 and with a kinematic viscosity measured according to ASTM D445 of at least 170 cSt to 100° C. Hereafter, this compound is called PMA of low molecular weight,
- a non-dispersed linear polymethacrylate with a weight-average molecular mass Mw equal to 60,000 (ASTM D5296). Hereafter, this compound is called PMA of average molecular weight,
- dispersant which is a polyisobutylene derivative, in particular a polyisobutylene succinimide derivative,
- aminated antioxidant which is of diphenylamine type,
- phenolic anticorrosion additive which is of ethoxylated phenolic type,
- zinc dithiophosphate which is a zinc alkyl dithiophosphate comprising $C_4$, $C_6$ and $C_8$ alkyl chains,
- sulphonates which are calcium or sodium alkylbenzene sulphonates,
- alkylphosphites which are dibutyl phosphites,
- sulphur-containing olefins which are sulphur-containing 2,4,4-trimethyl pentenes,
- dilution oil of Group I.

The % by mass of the components of the lubricant compositions are shown in Table I below, as well as the Cameron Plint results.

The friction properties of the formulae were evaluated using a Cameron-Plint TE-77 reciprocating tribometer. The operating principle is for example described in the publication "Friction Force Measurement in Reciprocating Tribometers" by A G Plint, published by STLE (Society of Tribologists and Lubrication Engineers) in 2011. The procedure used measures the coefficient of friction of a roller on a plane, all immersed in the test lubricant, under conditions of temperature (60° C., 100° C. and 140° C.), load (50, 100, 150 and 200N) and frequency (5, 10, 20 and 40 Hz) that can be varied in order to reproduce the friction conditions encountered in the control mechanisms of the gearboxes during use.

The course of the roller on the plane, i.e. the reciprocating stroke movement, is fixed at 7 mm. The test duration is 10 minutes. The reduction of the friction under these test conditions makes it possible to indicate a reduction in the gear-changing efforts and in the friction losses in the gears of the gearbox operating with the type of lubricant studied.

TABLE I

| Lubricant composition | 1 | 2 | 3 | 4 | 5 | 6 | 7 | 8 |
|---|---|---|---|---|---|---|---|---|
| Ethylene/alpha-olefin copolymer | — | 5.8 | — | 5.8 | — | 5.8 | 8.8 | 5.8 |
| PMA of low mass | 12.9 | — | 12.9 | — | 12.9 | 5 | — | |
| PMA of average mass | 5 | 5 | 5 | 5 | 5 | — | — | 5 |
| Dimercaptothiadiazole | — | — | — | — | 0.5 | 0.5 | 0.5 | 2.3 |
| Amine dithiophosphates | — | | 1.6 | 1.6 | 0.8 | 0.8 | 0.8 | |
| Dispersant | — | — | — | — | 0.5 | 0.5 | 0.5 | 0.5 |
| Aminated antioxidant | — | — | — | — | 0.8 | 0.8 | 0.8 | 0.8 |
| Phenolic anti-corrosion additive | — | — | — | — | 0.2 | 0.2 | 0.2 | 0.2 |
| Zinc dithiophosphate | 1.2 | 1.2 | — | — | — | — | — | |
| Sulphonates | 1.2 | 1.2 | — | — | — | — | — | |
| Alkylphosphite | 0.3 | 0.3 | — | — | — | — | — | |
| Sulphur-containing olefins | 1.5 | 1.5 | 1.5 | 1.5 | — | — | — | |
| Dilution oil of Group I | 3.8 | 3.8 | 3.4 | 3.4 | 4.2 | 4.2 | 4.2 | 4.2 |
| Base oil of Group III | 74.1 | 81.2 | 75.6 | 82.7 | 75.1 | 82.2 | 84.2 | 81.2 |
| KV100 (cSt) | 6.29 | 6.21 | 6.32 | 6.23 | 6.53 | 6.51 | 6.5 | 6.21 |
| μmin 62° C. | 0.098 | 0.099 | 0.066 | 0.072 | 0.09 | 0.084 | 0.068 | 0.099 |
| μmin 102° C. | 0.1 | 0.098 | 0.056 | 0.062 | 0.101 | 0.087 | 0.039 | 0.098 |
| μmin 142° C. | 0.09 | 0.087 | 0.054 | 0.052 | 0.114 | 0.089 | 0.036 | 0.087 |

The value of the coefficient of friction measured in gamin, taken at different temperatures, corresponds to the minimum value of the coefficient of friction taken over the average of the 4 loads during the last minute of the test.

Lubricant compositions 1 to 4 are control lubricant compositions. The lubricant compositions 6 and 7 are lubricant compositions according to the invention.

Lubricant compositions 1, 3 and 5 contain no ethylene and alpha-olefin copolymer. The measured coefficients of friction correspond to those which can be expected by a person skilled in the art.

Composition 8 is a lubricant composition comprising no amine thiophosphate. An ethylene and alpha-olefin copolymer was added to lubricant compositions 2, 4 and 6. In lubricant compositions 2 and 4, this addition leads to no reduction in the coefficient of friction.

On the other hand, it is remarkable to observe that in lubricant composition 6, this addition leads to a reduction in the coefficient of friction. It is even more remarkable to observe that lubricant composition 7 according to the invention unexpectedly has a very low coefficient of friction. It is also remarkable to observe that the presence of amine thiophosphate in the lubricant composition makes it possible to significantly reduce the coefficient of friction, in comparison with composition 8 which comprises no amine thiophosphate.

Thus the combination of an ethylene/alpha-olefin copolymer, a dimercaptothiadiazole and an amine thiophosphate in a lubricant composition improves the coefficient of friction of said composition. It should be noted that the composition of Example 7 has a loss of viscosity measured at 100° C. according to the standardized test CEC L-45-99 of 2.6%; such a loss-of-viscosity value being perfectly suitable for the use of the composition in the lubrication of transmission components, and more particularly of gearboxes.

The invention claimed is:

1. A lubricant composition comprising one or more base oils, at least one dimercaptothiadiazole derivative, at least one ethylene and alpha-olefin copolymer and at least one amine thiophosphate of general formula (IVa):

(IVa)

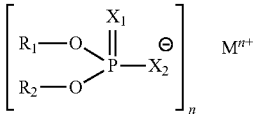

in which $X_1$ and $X_2$ are independently of each other a sulphur atom or an oxygen atom, at least one of them being a sulphur atom, $R_1$ and $R_2$ are either a hydrogen atom or alkyl groups having between 1 and 22 carbon atoms, M is an ammonium formed from a primary, secondary or tertiary amine, of formula $R_3R_4R_5R_6N$, where $R_3$, $R_4$, $R_5$, $R_6$ are either a hydrogen atom or an alkyl group comprising from 1 to 18 carbon atoms, and then n=1.

2. The lubricant composition according to claim 1 wherein the ethylene and alpha-olefin copolymer is an ethylene and alpha-olefin copolymer comprising from 3 to 30 carbon atoms.

3. The lubricant composition according to claim 1 wherein the ethylene and alpha-olefin copolymer has the general formula (I):

(I)

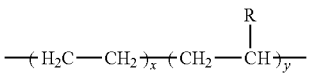

in which R is an alkyl group having from 1 to 8 carbon atoms, x and y are such that the ratio x/y is comprised between 0.5 and 2 and the sum x+y is comprised between 50 and 150.

4. The lubricant composition according to claim 1 wherein the quantity of ethylene and alpha-olefin copolymer is comprised between 1 and 20% by mass, with respect to the total mass of lubricant composition.

5. The lubricant composition according to claim 1 wherein the dimercaptothiadiazole derivative is chosen from 4,5-dimercapto-1,2,3-thiadiazole, 3,5-dimercapto-1,2,4-thiadiazole, 3,4-dimercapto-1,2,5-thiadiazole, and 2,5-dimercapto-1,3,4-thiadiazole derivatives, used alone or in a mixture.

6. The lubricant composition according to claim 1 wherein the dimercaptothiadiazole derivative has, as general formula, formula (II) or (III), used alone or in a mixture:

(II)

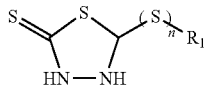

(III)

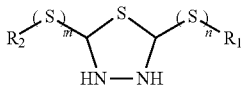

in which $R_1$ and $R_2$ are, independently of each other, hydrogen atoms, linear and/or branched alkyl groups comprising from 1 to 24 carbon atoms or aromatic substituents, n and m being independently of each other integers chosen from the group formed by the integers 1, 2, 3 or 4.

7. The lubricant composition according to claim 1 wherein the quantity of dimercaptothiadiazole derivative is comprised between 0.1 and 10% by mass, with respect to the total mass of the lubricant composition.

8. The lubricant composition according to claim 1 wherein the quantity of amine thiophosphate is comprised between 0.2 to 10% by mass, with respect to the total mass of lubricant composition.

9. The lubricant composition according to claim 1 further comprising a polymethacrylate.

10. The lubricant composition according to claim 1 further comprising a dispersant derived from polyisobutene.

11. The lubricant composition according to claim 1 further comprising an amine-type antioxidant additive.

12. The lubricant composition according to claim 1 further comprising a phenol-type anti-corrosion additive.

13. The lubricant composition according to claim 1 having a kinematic viscosity at 100° C. according to the standard ASTM D445 comprised between 4 and 40 cSt.

14. A process for using a lubricant comprising one or more base oils, at least one dimercaptothiadiazole derivative, at least one ethylene and alpha-olefin copolymer and at least one amine thiophosphate of general formula (IVa):

(IVa)

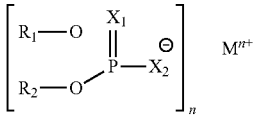

in which $X_1$ and $X_2$ are independently of each other a sulphur atom or an oxygen atom, at least one of them being a sulphur atom, $R_1$ and $R_2$ are either a hydrogen atom or alkyl groups having between 1 and 22 carbon atoms, M is an ammonium formed from a primary, secondary or tertiary amine, of formula $R_3R_4R_5R_6N$, where $R_3$, $R_4$, $R_5$, $R_6$ are either a hydrogen atom or an alkyl group comprising from 1 to 18 carbon atoms, and then n=1; the process comprising lubricating a transmission member comprising bringing into contact the lubricant with at least one transmission member.

15. A process for lubricating with a lubricant comprising one or more base oils, at least one dimercaptothiadiazole derivative, at least one ethylene and alpha-olefin copolymer and at least one amine thiophosphate of general formula (IVa):

(IVa)

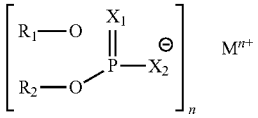

in which $X_1$ and $X_2$ are independently of each other a sulphur atom or an oxygen atom, at least one of them being a sulphur atom, $R_1$ and $R_2$ are either a hydrogen atom or alkyl groups having between 1 and 22 carbon atoms, M is an ammonium formed from a primary, secondary or tertiary amine, of formula $R_3R_4R_5R_6N$, where $R_3$, $R_4$, $R_5$, $R_6$ are either a hydrogen atom or an alkyl group comprising from 1 to 18 carbon atoms, and then n =1; the process comprising reducing fuel consumption of a vehicle by bringing into contact an engine of the vehicle with the lubricant.

* * * * *